US011910908B2

(12) United States Patent
Zhong

(10) Patent No.: US 11,910,908 B2
(45) Date of Patent: Feb. 27, 2024

(54) LIPSTICK TUBE WITH REPLACEABLE MECHANISM

(71) Applicant: SHYA HSIN PACKAGING INDUSTRY (CHINA) CO., LTD., Kunshan (CN)

(72) Inventor: Hua Zhong, Kunshan (CN)

(73) Assignee: SHYA HSIN PACKAGING INDUSTRY (CHINA) CO., LTD., Kunshan (CN)

( * ) Notice: Subject to any disclaimer, the term of this patent is extended or adjusted under 35 U.S.C. 154(b) by 110 days.

(21) Appl. No.: 17/771,501

(22) PCT Filed: Jul. 28, 2020

(86) PCT No.: PCT/CN2020/104998
§ 371 (c)(1),
(2) Date: Apr. 25, 2022

(87) PCT Pub. No.: WO2021/088432
PCT Pub. Date: May 14, 2021

(65) Prior Publication Data

US 2022/0369789 A1 Nov. 24, 2022

(30) Foreign Application Priority Data

Nov. 4, 2019 (CN) ..... 201911064180.9

(51) Int. Cl.
*A45D 40/06* (2006.01)
*A45D 40/00* (2006.01)
*A45D 40/20* (2006.01)

(52) U.S. Cl.
CPC ..... *A45D 40/06* (2013.01); *A45D 2040/0056* (2013.01); *A45D 2040/204* (2013.01)

(58) Field of Classification Search
CPC ..... A45D 40/06; A45D 2040/0056; A45D 2040/204; A45D 40/205; A45D 40/02; A45D 40/04; A45D 2040/208
(Continued)

(56) References Cited

U.S. PATENT DOCUMENTS 4,884,912 A * 12/1989 Gueret ..... A45D 40/06 401/86
5,399,040 A * 3/1995 Holloway ..... A45D 40/06 401/86

(Continued)

FOREIGN PATENT DOCUMENTS

CN 201438890 U 4/2010
CN 108523378 A 9/2018

(Continued)

*Primary Examiner* — David J Walczak
(74) *Attorney, Agent, or Firm* — Bayramoglu Law Offices LLC

(57) ABSTRACT

A lipstick tube with a replaceable mechanism includes a base and the mechanism. The mechanism includes a barrel, a fork, a spiral and an aluminum shell that are coaxially sleeved sequentially from inside out. A barrel engaging member integrally protrudes from an outer side wall of the barrel. A hollow guide groove extending in an axial direction of the fork is formed in the fork. A spiral guide groove extending in an axial direction of the spiral component and spiraling upward is formed in an inner side wall of the spiral component. The barrel engaging member is configured for passing through the hollow guide groove and then being embedded into and sliding in the spiral guide groove. The spiral component is configured for axially stopping and circumferentially rotating relative to the fork. The aluminum shell is configured for being fixed in position relative to the spiral component.

5 Claims, 10 Drawing Sheets

(58) Field of Classification Search
USPC ..... 401/75–78, 88
See application file for complete search history.

(56) References Cited

U.S. PATENT DOCUMENTS

| | | | | |
|---|---|---|---|---|
| 5,605,408 | A | 2/1997 | Su | |
| 8,132,977 | B2 * | 3/2012 | Pires | A45D 40/06 401/88 |

FOREIGN PATENT DOCUMENTS

| | | | |
|---|---|---|---|
| CN | 109043797 | A | 12/2018 |
| CN | 110876525 | A | 3/2020 |
| FR | 3074659 | A1 | 6/2019 |
| JP | H1085039 | A | 4/1998 |
| WO | 2008064448 | A1 | 6/2008 |
| WO | 2018035971 | A1 | 3/2018 |

* cited by examiner

LIPSTICK TUBE WITH REPLACEABLE MECHANISM

CROSS REFERENCE TO THE RELATED APPLICATIONS

This application is the national phase entry of International Application No. PCT/CN2020/104998, filed on Jul. 28, 2020, which is based upon and claims priority to Chinese Patent Application No. 201911064180.9, filed on Nov. 4, 2019, the entire contents of which are incorporated herein by reference.

TECHNICAL FIELD

The present invention relates to the technical field of lipsticks, and in particular, relates to a lipstick tube with a replaceable mechanism.

BACKGROUND

The traditional lipstick tube structurally includes a base and a mechanism, and the mechanism includes a barrel (used to hold lipstick), a fork, a spiral component and an aluminum shell that are coaxially sleeved sequentially from inside out. When in use, by rotating the aluminum shell and the spiral component (which are fixedly connected), the barrel moves upward along a hollow guide groove on the fork and a spiral guide groove on the inner side wall of the spiral component until the lipstick is pushed out of the upper port of the aluminum shell.

However, in the traditional lipstick tube, the base and the fork are fixedly connected, that is, the base and the mechanism are inseparable, so when the lipstick is used up, the entire lipstick tube will become "waste" and be discarded, and correspondingly, consumers also need to buy a complete lipstick. Therefore, this not only increases the pressure on environmental protection, but also increases the shopping expenses of the consumers.

In view of this, the present invention is specifically provided.

SUMMARY

In order to overcome the above defects, the present invention provides a lipstick tube with a replaceable mechanism. On the one hand, the lipstick tube is simple and novel in structure, and easy to operate, and consumers can easily separate and combine the mechanism and a base, which greatly satisfies demands of the consumers. On the other hand, it also saves shopping costs for the consumers and makes the lipstick tube more environmentally friendly.

The present invention solves the technical problems with the following technical solution: a lipstick tube with a replaceable mechanism includes a base and the mechanism. The mechanism includes a barrel, a fork, a spiral component and an aluminum shell that are coaxially sleeved sequentially from inside out, a barrel engaging member integrally protrudes from an outer side wall of the barrel, a hollow guide groove extending in an axial direction of the fork is formed in the fork, a spiral guide groove extending in an axial direction of the spiral component and spiraling upward is formed in an inner side wall of the spiral component, the barrel engaging member is configured for passing through the hollow guide groove and then being embedded into and sliding in the spiral guide groove, the spiral component is also configured for axially stopping and circumferentially rotating relative to the fork, and the aluminum shell is also configured for being fixed in position relative to the spiral component. A bottom of the fork is configured for being detachably engaged on the base, and the fork is also configured for circumferentially stopping relative to the base.

As a further improvement of the present invention, the base may include a base casing in a hollow cylindrical shape and with an open upper shaft end, a base inner column integrally formed on an inner surface of a lower shaft end of the base casing and extending in an axial direction of the base casing, and a receiving cavity formed between the base casing and the base inner column; a circle of barb ribs may also be formed in an inner side wall of the base casing, and a circle of anti-rotation teeth A may also be formed at an upper part of an outer side wall of the base inner column.

The fork may include a fork body, the fork body may be of a hollow cylindrical structure with an open upper shaft end and an open lower shaft end, a plurality of separation grooves extending in an axial direction of the fork body and opening at the lower shaft end of the fork body may be formed at a bottom of the fork body, and the plurality of separation grooves may be arranged in a ring row to separate the bottom of the fork body into a plurality of elastic members. The plurality of elastic members may include a plurality of first elastic members and a plurality of second elastic members that are alternately distributed in sequence, an elastic hook may be integrally formed on an outer side wall of each of the first elastic members, and a convex rib may be integrally formed on an outer side wall of each of the second elastic members. An inner side wall of the fork body may extend radially inward at a position adjacent to the plurality of separation grooves to form a convex ring, and a circle of anti-rotation teeth B may also be formed on an inner wall of the convex ring.

When the bottom of the fork body is inserted into the receiving cavity, the plurality of elastic hooks may be configured for being respectively engaged with the barb ribs, and the anti-rotation teeth B may be configured for being connected to the anti-rotation teeth A in an anti-rotation fit.

As a further improvement of the present invention, the base inner column may also be of a hollow cylindrical structure with an open upper shaft end, and the base inner column may also be coaxially arranged with the base casing.

In addition, a plurality of supporting ribs A distributed in a ring row may integrally protrude from an inner side wall of a lower part of the base casing, a plurality of supporting ribs B distributed in a ring row may also integrally protrude from an outer side wall of a lower part of the base inner column, and the plurality of supporting ribs A and the plurality of supporting ribs B may be located at a same radial plane.

A ring-shaped vertical weight may also be provided, the vertical weight may be disposed in the receiving cavity, and the plurality of supporting ribs A and the plurality of supporting ribs B may correspondingly abut against an outer side wall and an inner side wall of the vertical weight, respectively.

As a further improvement of the present invention, a first limit ring may integrally protrude from an outer side wall of the upper shaft end of the fork body, a second limit ring may integrally protrude from an outer side wall of a lower part of the fork body, a part between the first limit ring and the second limit ring on the fork body may be defined as an installation section, and the hollow guide groove may be formed in the installation section.

The spiral component may include a spiral body in a hollow straight circular tubular shape, the spiral body may be movably sleeved on the installation section, and the first limit ring and the second limit ring may stop and limit an upper shaft end and a lower shaft end of the spiral body respectively. The spiral guide groove may be formed in an inner side wall of the spiral body.

As a further improvement of the present invention, the aluminum shell may include an aluminum shell body in a hollow straight circular tubular shape, and the aluminum shell body may be sleeved outside the spiral body, and may also be fixedly connected to the spiral body through dispensing fixation.

In addition, a circular groove may be formed on an outer side wall of the fork body and located between the second limit ring and the elastic members, a plurality of elastic pieces may be arranged in a ring row in the groove, and the plurality of elastic pieces may each elastically abut against an inner side wall of the aluminum shell body.

As a further improvement of the present invention, a cover may further be provided, the cover may include a cover body, the cover body may be of a hollow cylindrical structure with an open lower shaft end, and a circular engaging groove may be recessed on an inner side wall of the cover body at a position adjacent to a lower opening of the cover body.

In addition, an outer diameter of an upper part of the base casing may be less than an outer diameter of a middle and lower part of the base casing, a plurality of base engaging members distributed in a ring row may integrally protrude from an outer side wall of the upper part of the base casing, and the plurality of base engaging members may each be configured for being engaged with the engaging groove.

The beneficial effects of the present invention are as follows: through structural improvement, the fork and the base are designed in a "detachable engagement and circumferential stop" connection mode, which is convenient for the consumers to easily separate and combine the mechanism and the base through an operation mode of "pulling out" and "pressing down" on the basis of ensuring a stable structure of a lipstick tube, that is: when new lipstick needs to be replaced, the consumers can easily pull out the old mechanism, and install the new mechanism successfully by pressing down. In conclusion, on the one hand, the lipstick tube of the present invention is simple and novel in structure, and easy to operate, which greatly satisfies demands of the consumers. On the other hand, in the lipstick tube of the present invention, the base and the cover can be recycled, which not only saves shopping costs for the consumers, but also makes the lipstick tube more environmentally friendly.

REFERENCE NUMERALS

Figure 1:
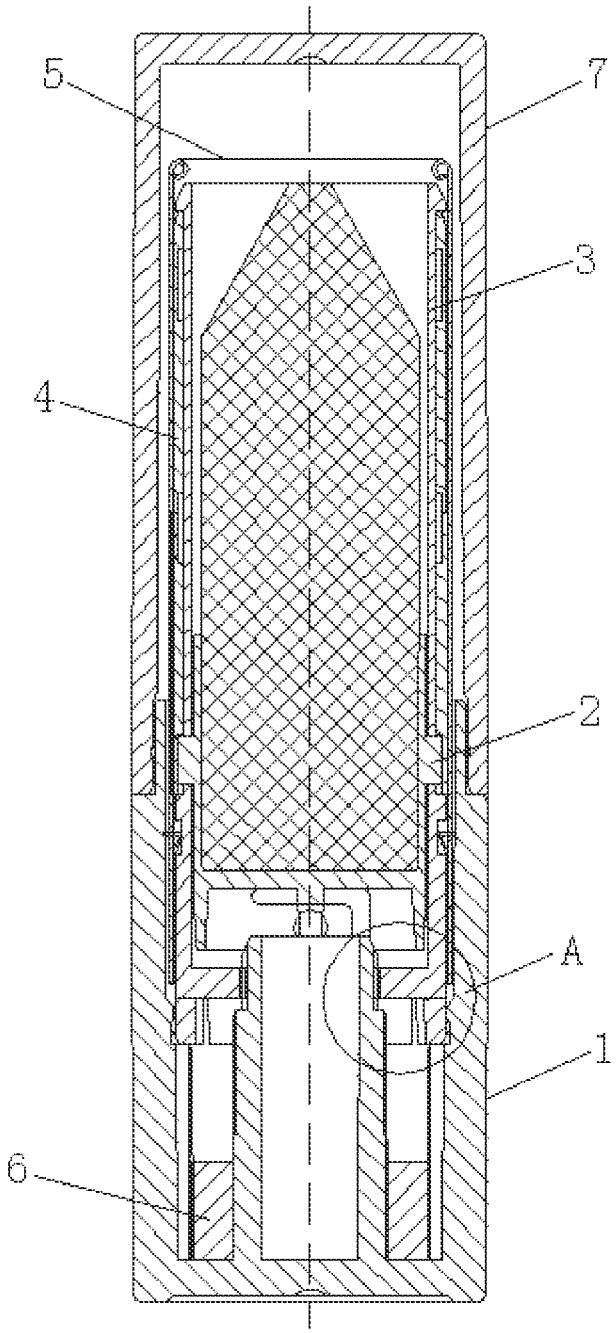
FIG. 1 is a cross-sectional structural diagram of a lipstick tube with a replaceable mechanism according to the present invention.
Figure 2:
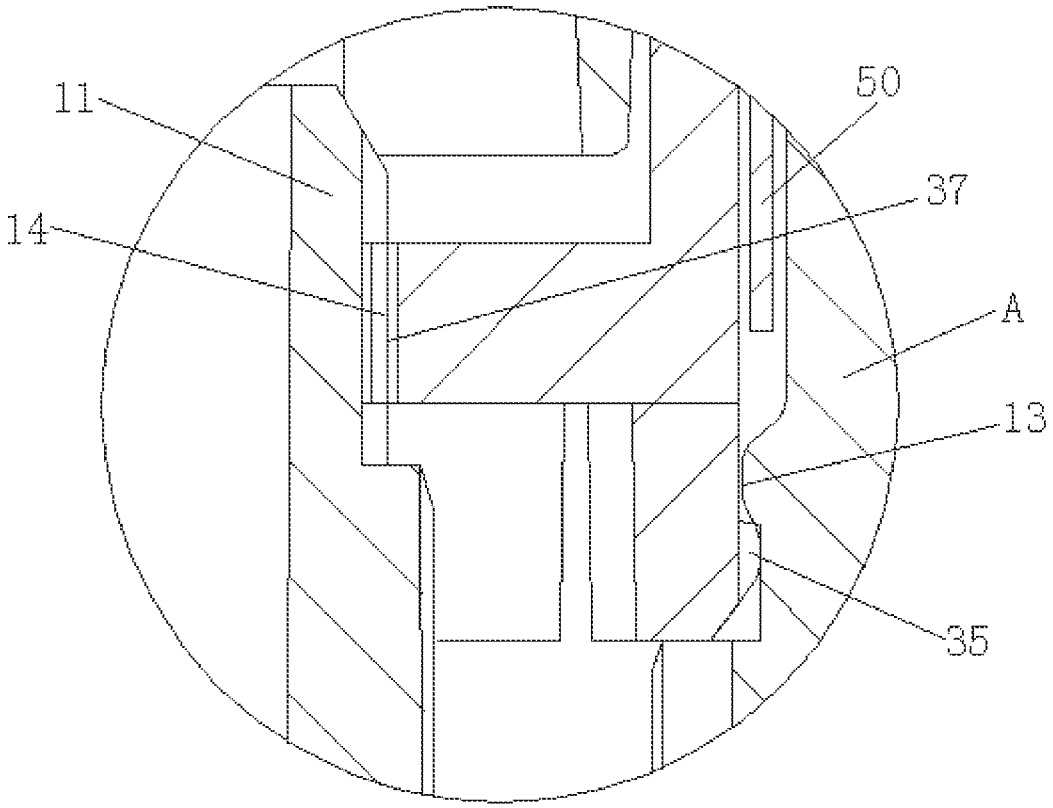
FIG. 2 is an enlarged structural diagram of a part A shown in FIG. 1.
Figure 3:
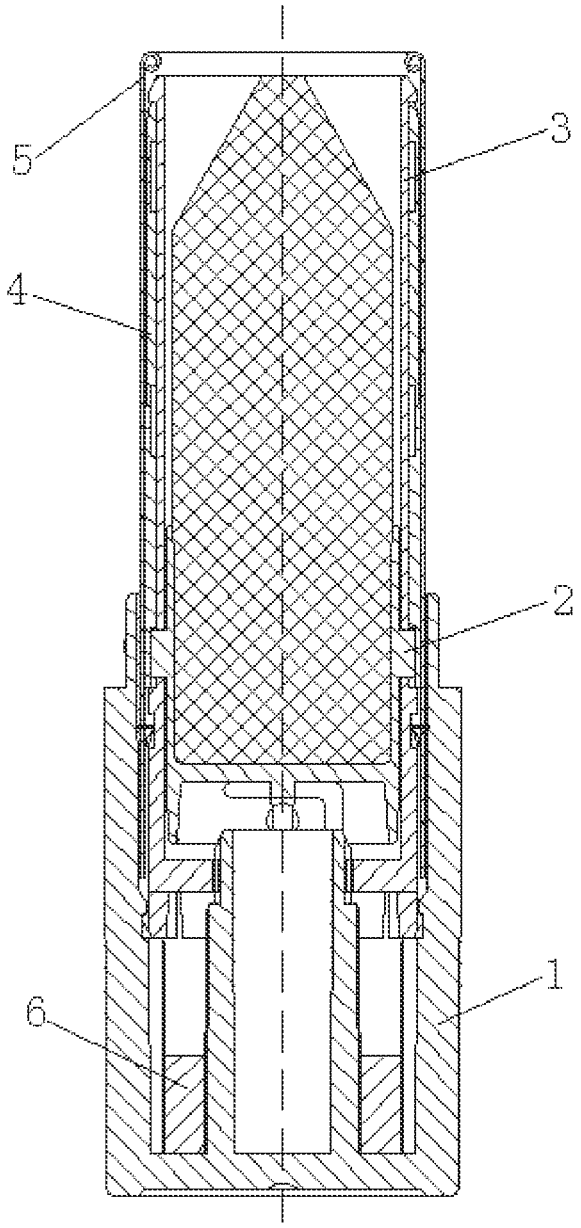
FIG. 3 is a schematic diagram of a state of the lipstick tube shown in FIG. 1 after a cover is removed.

1—base
10—base casing
11—base inner column
12—receiving cavity
13—barb rib
14—anti-rotation tooth A
15—supporting rib A
16—supporting rib B
17—base engaging member
2—barrel
20—barrel engaging member
3—fork
30—hollow guide groove
31—fork body
32—separation groove
33—first elastic member
34—second elastic member
35—elastic hook
36—convex rib
37—anti-rotation tooth B
38—first limit ring
39—second limit ring
310—elastic piece
4—spiral component
40—spiral guide groove
41—spiral body
5—aluminum shell
50—aluminum shell body
6—vertical weight
7—cover
70—cover body
71—engaging groove

DETAILED DESCRIPTION OF THE EMBODIMENTS

A specific embodiment of the present invention will be described below, and other advantages and effects of the present invention will become apparent for those skilled in the art from the content disclosed in this specification.

The structure, scale, size, and the like shown in the drawings of this specification are only used to match the content disclosed in the specification and for those skilled in the art to understand and read, which are not used to limit the limitations for implementing the present invention and thus are not technically substantial. Any structural modification, scaling relation change, or size adjustment made without affecting the effects and objectives that can be achieved by the present invention shall fall within the scope that can be encompassed by the technical content disclosed in the present invention. As used herein, the terms such as "first", "second", "A", and "B" are merely employed for ease of description, and not intended to limit the applicable scope of the present invention, and the change or adjustment of the relative relations shall be deemed as falling within the applicable scope of the present invention without substantial alteration of technical contents.

Embodiment 1

FIG. 1 to FIG. 4 are a cross-sectional structural diagram of a lipstick tube with a replaceable mechanism according to the present invention, an enlarged structural diagram of a local part (part A), a schematic diagram of a state of the lipstick tube after a cover is removed, and a schematic diagram of a state of the lipstick tube after the mechanism is pulled out respectively.

Figure 10:
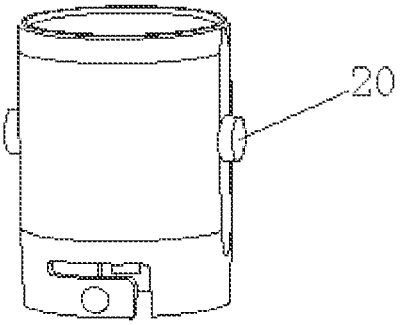
FIG. 10 is a three-dimensional structural diagram of a barrel according to the present invention.
Figure 11:
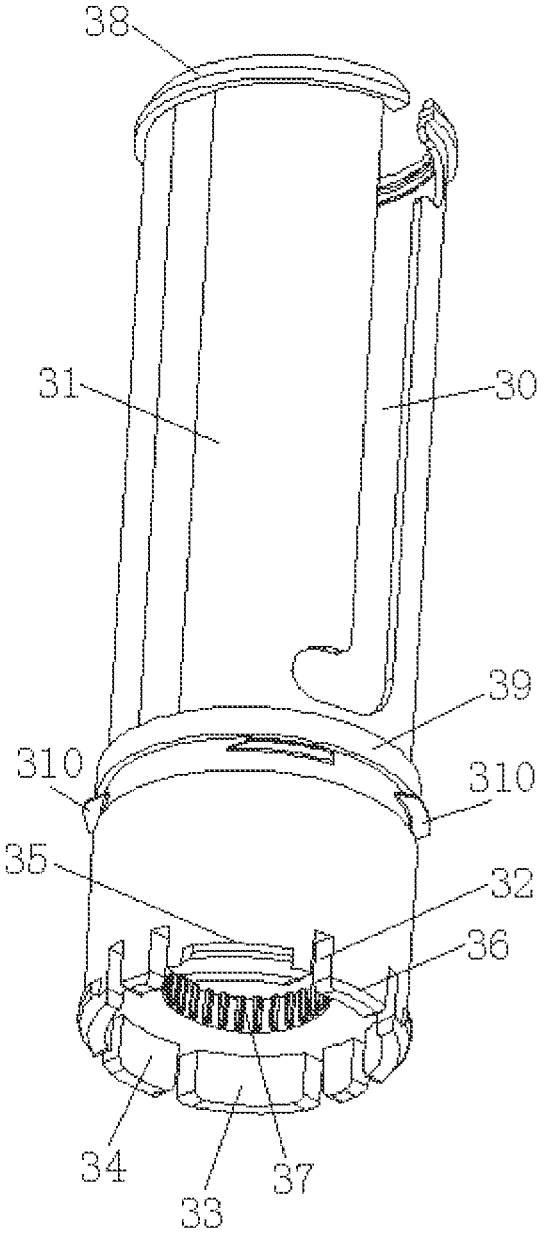
FIG. 11 is a three-dimensional structural diagram of a fork according to the present invention.
Figure 12:
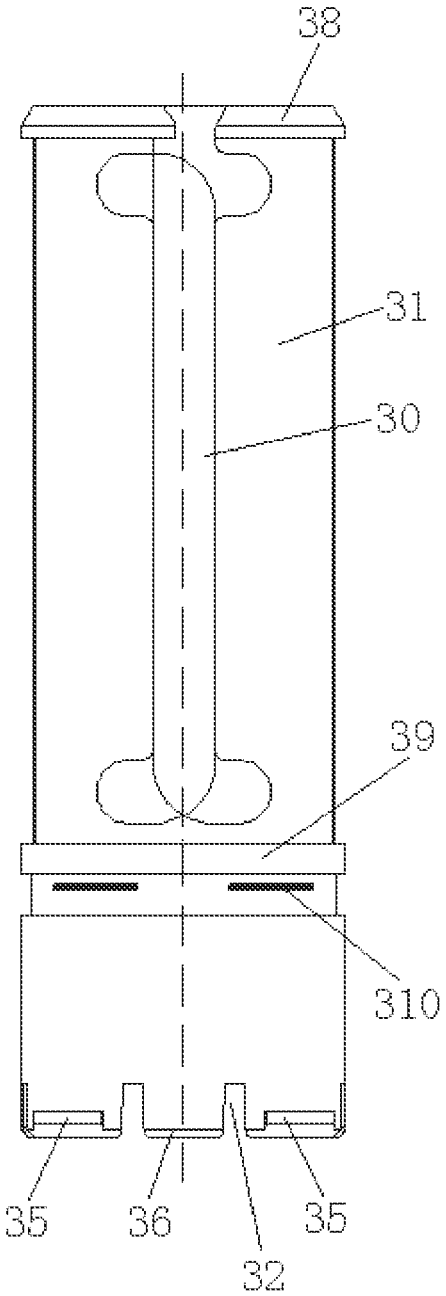
FIG. 12 is a side-view structural diagram of the fork according to the present invention.

A lipstick tube with a replaceable mechanism of the present invention includes a base 1 and the mechanism. The mechanism includes a barrel 2 (used to hold lipstick), a fork 3, a spiral component 4 and an aluminum shell 5 that are coaxially sleeved sequentially from inside out. A barrel engaging member 20 (two barrel engaging members are shown in FIG. 10, but not limited to two) integrally protrudes from an outer side wall of the barrel 2. A hollow guide groove 30 (two hollow guide grooves are shown in FIG. 11 and FIG. 12, and are matched with the number of the barrel engaging members) extending in an axial direction of the fork is formed in the fork 3. A spiral guide groove 40 (referring to FIG. 14) extending in an axial direction of the spiral component and spiraling upward is formed in an inner side wall of the spiral component 4, the barrel engaging member 20 is configured for passing through the hollow guide groove 30 and then being embedded into and sliding in the spiral guide groove 40. In addition, the spiral component 4 is also configured for axially stopping and circumferentially rotating relative to the fork 3, and the aluminum shell 5 is also configured for being fixed in position relative to the spiral component 4. In particular, a bottom of the fork 3 is configured for being detachably engaged on the base 1, and the fork 3 is also configured for circumferentially stopping relative to the base 1.

Figure 5:
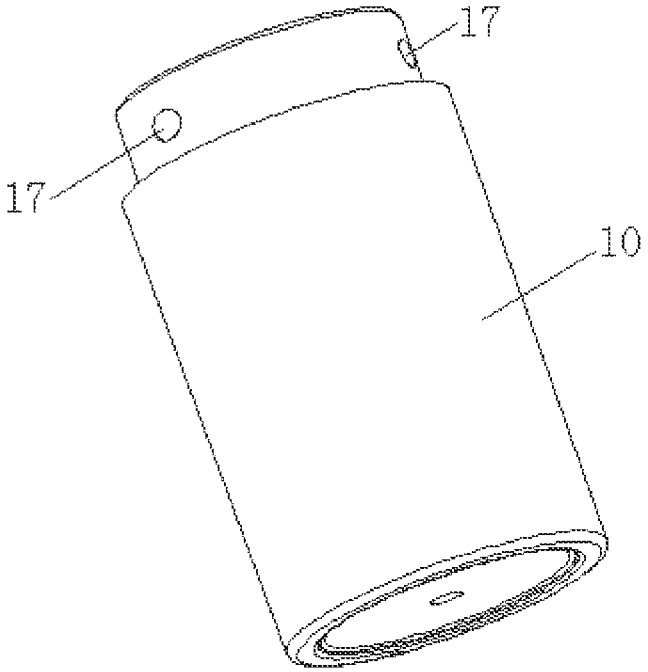
FIG. 5 is a three-dimensional structural diagram of a base according to the present invention.
Figure 6:
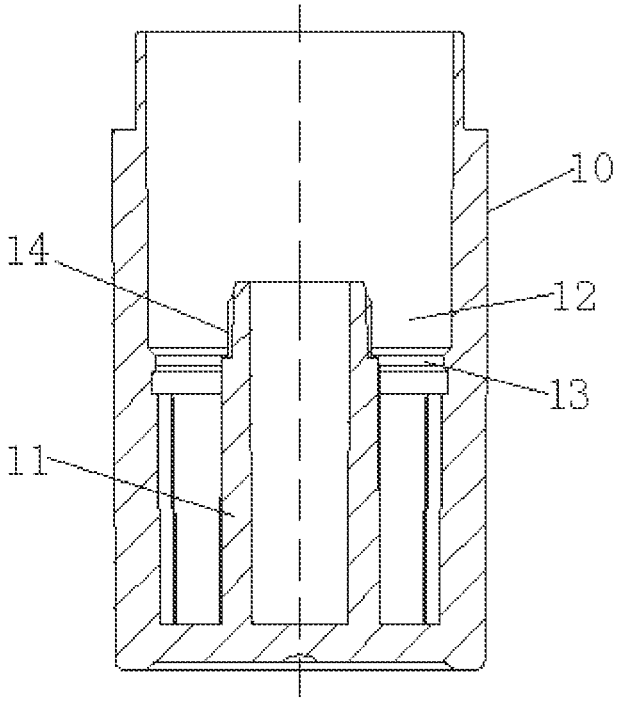
FIG. 6 is a cross-sectional structural diagram of the base according to the present invention at a first viewing angle.
Figure 7:
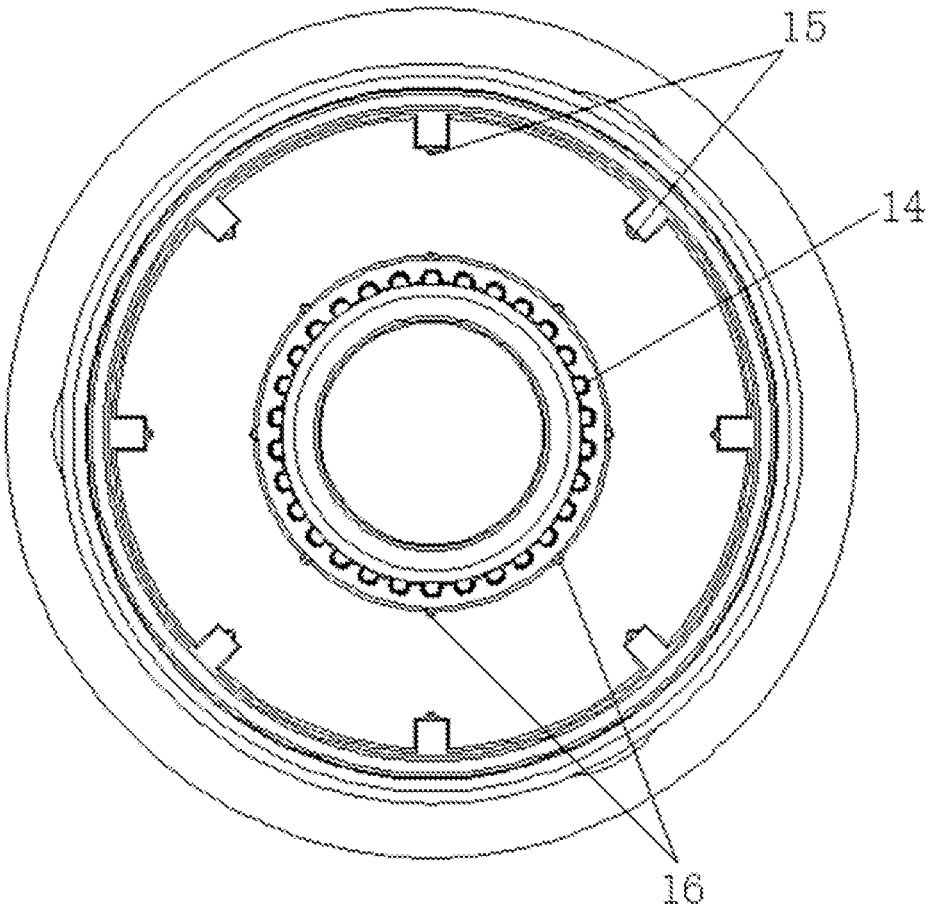
FIG. 7 is a cross-sectional structural diagram (enlarged view) of the base according to the present invention at a second viewing angle.

In the present embodiment, preferably, referring to FIG. 5 to FIG. 7, the base 1 includes a base casing 10 in a hollow cylindrical shape and with an open upper shaft end, a base inner column 11 integrally formed on an inner surface of a lower shaft end of the base casing 10 and extending in an axial direction of the base casing, and a receiving cavity 12 formed between the base casing 10 and the base inner column 11. A circle of barb ribs 13 are also formed in an inner side wall of the base casing 10. A circle of anti-rotation teeth A 14 are also formed at an upper part of an outer side wall of the base inner column 11.

Figure 13:
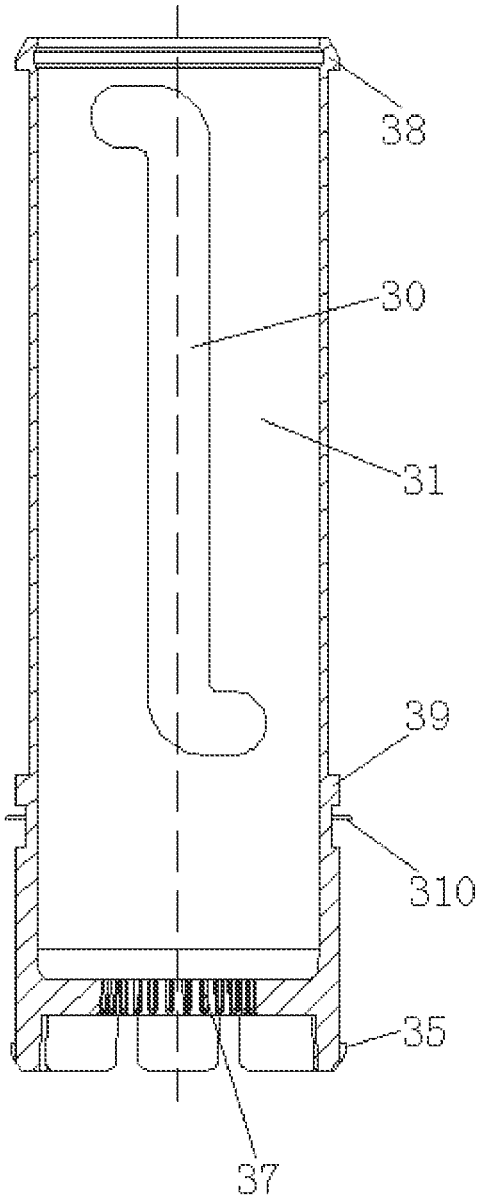
FIG. 13 is a cross-sectional structural diagram of the fork according to the present invention.

Referring to FIG. 11 to FIG. 13 again, the fork 3 includes a fork body 31, the fork body 31 is of a hollow cylindrical structure with an open upper shaft end and an open lower shaft end, a plurality of separation grooves 32 extending in an axial direction of the fork body 31 and opening at the lower shaft end of the fork body 31 are formed at a bottom of the fork body 31, and the plurality of separation grooves 32 are arranged in a ring row to separate the bottom of the fork body 31 into a plurality of elastic members. Since each elastic member is individually separated, it is elastic. The plurality of elastic members include a plurality of first elastic members 33 and a plurality of second elastic members 34 that are alternately distributed in sequence, an elastic hook 35 is integrally formed on an outer side wall of each of the first elastic members 33, and a convex rib 36 is integrally formed on an outer side wall of each of the second elastic members 34. An inner side wall of the fork body 31 extends radially inward at a position adjacent to an upper side of the plurality of separation grooves 32 to form a convex ring, and a circle of anti-rotation teeth B 37 are also formed on an inner wall of the convex ring.

When the bottom of the fork body 31 is inserted into the receiving cavity 12, the plurality of elastic hooks 35 are configured for being respectively engaged with the barb ribs 13. Since the barb rib 13 is a ring body, it can be matched with the plurality of elastic hooks 35 in any direction, which is convenient for assembly. The anti-rotation teeth B 37 are configured for being connected to the anti-rotation teeth A 14 in an anti-rotation fit, such that the fork 3 will not rotate after being engaged on the base 1, and circumferentially stop relative to the base 1.

Further, preferably, the base inner column 11 is also of a hollow cylindrical structure with an open upper shaft end, and the base inner column 11 is also coaxially arranged with the base casing 10.

In addition, a plurality of supporting ribs A 15 distributed in a ring row integrally protrude from an inner side wall of a lower part of the base casing 10, a plurality of supporting ribs B 16 distributed in a ring row also integrally protrude from an outer side wall of a lower part of the base inner column 11, and the plurality of supporting ribs A 15 and the plurality of supporting ribs B 16 are located at a same radial plane.

Figure 8:
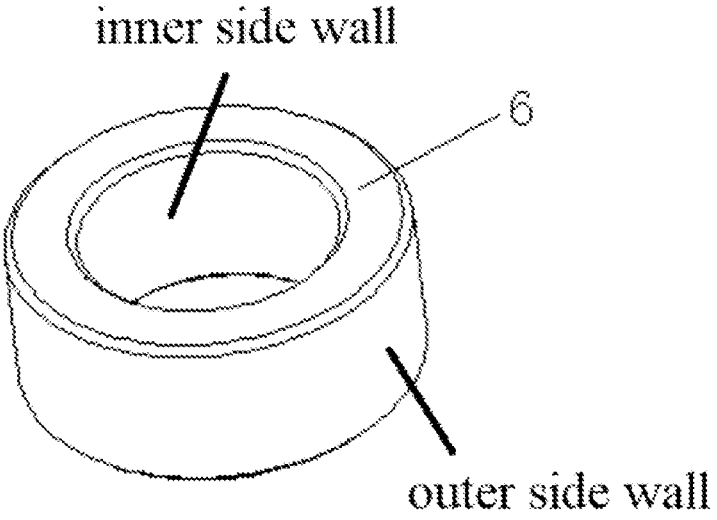
FIG. 8 is a three-dimensional structural diagram of a vertical weight according to the present invention.

A ring-shaped vertical weight 6 is also provided. Referring to FIG. 8, the vertical weight 6 is disposed in the receiving cavity 12, and the plurality of supporting ribs A 15 and the plurality of supporting ribs B 16 correspondingly abut against an outer side wall and an inner side wall of the vertical weight 6, respectively, such that the vertical weight 6 is fixed in position relative to the base 1.

Further, preferably, a first limit ring 38 integrally protrudes from an outer side wall of the upper shaft end of the fork body 31, a second limit ring 39 integrally protrudes from an outer side wall of a lower part of the fork body 31, a part between the first limit ring 38 and the second limit ring 39 on the fork body 31 is defined as an installation section, and the hollow guide groove 30 is formed in the installation section.

Figure 14:
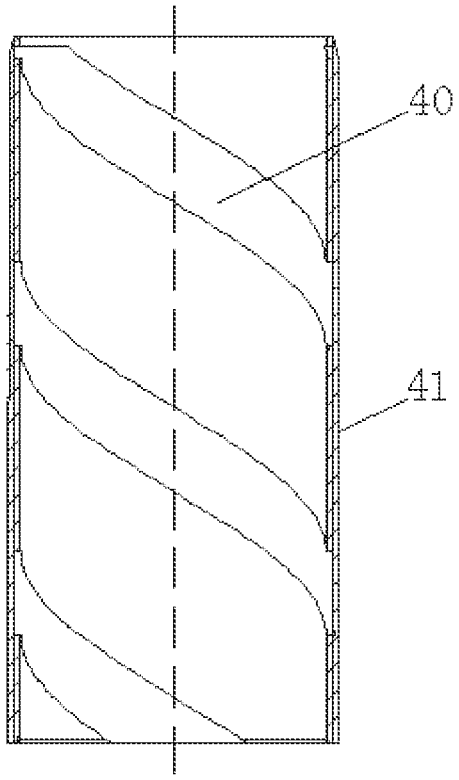
FIG. 14 is a cross-sectional structural diagram of a spiral component according to the present invention.

Referring to FIG. 14, the spiral component 4 includes a spiral body 41 in a hollow straight circular tubular shape, the spiral body 41 is movably sleeved on the installation section, and the first limit ring 38 and the second limit ring 39 stop and limit an upper shaft end and a lower shaft end of the spiral body 41 respectively, that is, the spiral component 4 circumferentially rotates and axially stops relative to the fork 3. In addition, the spiral guide groove 40 is formed in an inner side wall of the spiral body 41.

Figure 15:
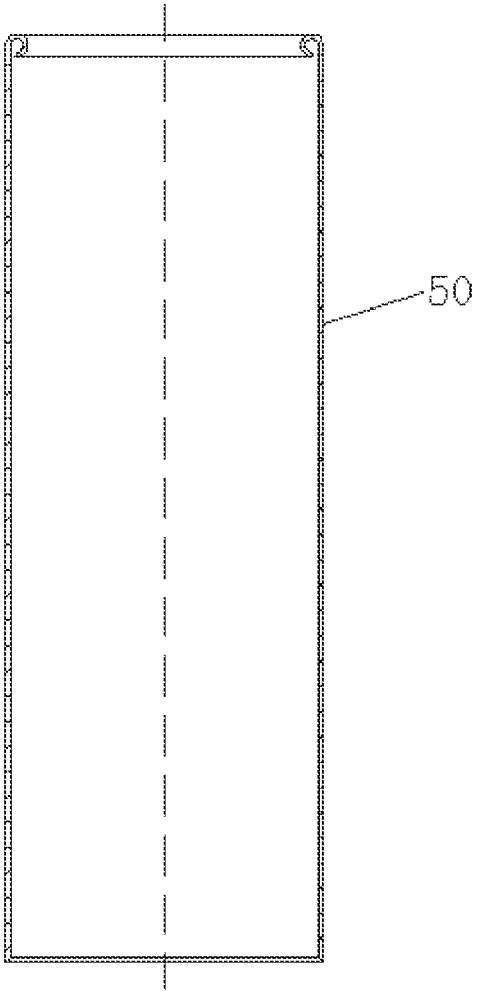
FIG. 15 is a cross-sectional structural diagram of an aluminum shell according to the present invention.

In the present embodiment, preferably, referring to FIG. 15, the aluminum shell 5 includes an aluminum shell body 50 in a hollow straight circular tubular shape, and the aluminum shell body 50 is sleeved outside the spiral body 41, and is also fixedly connected to the spiral body 41 through dispensing fixation. In addition, a circular groove is formed on an outer side wall of the fork body 31 and located between the second limit ring 39 and the elastic members, a plurality of elastic pieces 310 are arranged in a ring row in the groove, and the plurality of elastic pieces 310 each elastically abut against an inner side wall of the aluminum shell body 50. The plurality of elastic pieces are used to support the aluminum shell and maintain its stability.

Figure 4:
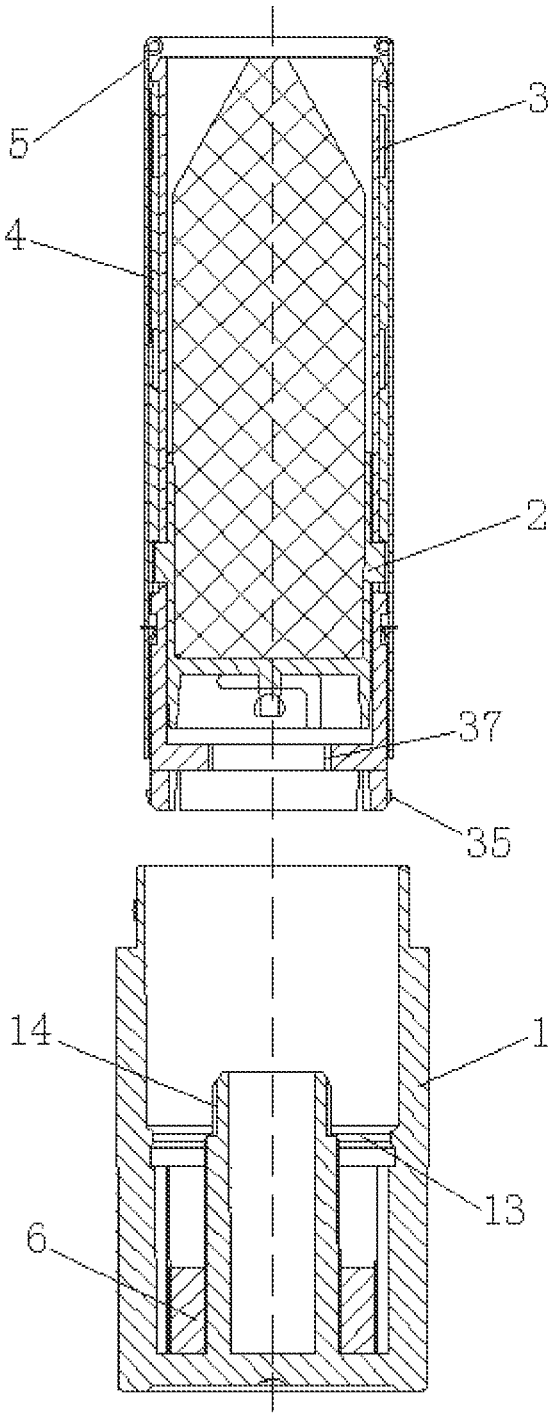
FIG. 4 is a schematic diagram of a state of the lipstick tube shown in FIG. 3 after the mechanism is pulled out.
Figure 9:
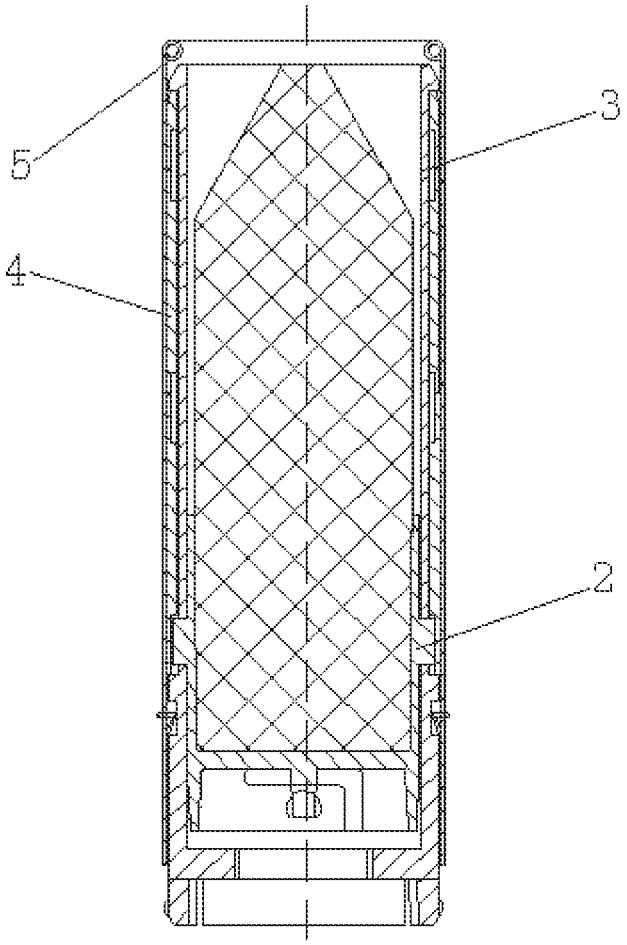
FIG. 9 is a cross-sectional structural diagram of the mechanism according to the present invention.

In addition, as can be seen from FIG. 4 and FIG. 9, the lower shaft end of the aluminum shell body 50 extends adjacent to the plurality of elastic members. When the bottom of the fork body 31 is inserted into the receiving cavity 12, the lower shaft end of the aluminum shell body 50 is also inserted into the receiving cavity 12.

Figure 16:
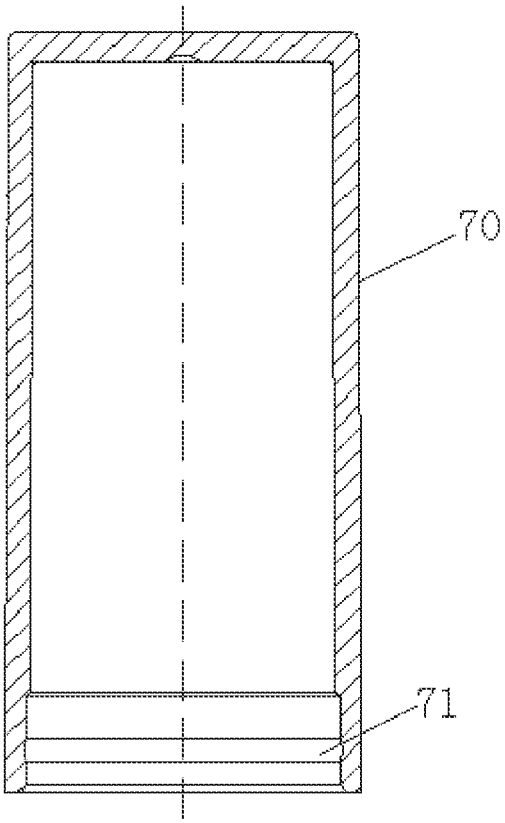
FIG. 16 is a cross-sectional structural diagram of the cover according to the present invention.

In the present embodiment, preferably, a cover 7 is further provided, the cover 7 includes a cover body 70, the cover body 70 is of a hollow cylindrical structure with an open lower shaft end, and a circular engaging groove 71 is recessed on an inner side wall of the cover body 70 at a position adjacent to a lower opening of the cover body 70, as shown in FIG. 16.

In addition, an outer diameter of an upper part of the base casing 10 is less than an outer diameter of a middle and lower part of the base casing 10, that is, a stepped shape is formed between the upper part and the middle and lower part of the base casing. A plurality of base engaging members 17 distributed in a ring row integrally protrude from an outer side wall of the upper part of the base casing 10, and the plurality of base engaging members 17 each are configured for being engaged with the engaging groove 71.

The following is a brief description of the replacement method of the mechanism in combination with the lipstick tube of the present invention: (1) when a mechanism A needs to be replaced, since each elastic member on the mechanism A is individually separated, it is elastic, then snap-fit connection between the plurality of elastic hooks 35 on the mechanism A and the barb ribs 13 is elastic, and then when the consumers pull out the mechanism A forcefully, the plurality of elastic hooks 35 on the mechanism A will be driven to be separated from the barb ribs 13, thereby pulling out the mechanism A. The pull-out state is shown in FIG. 4.

(2) When a new mechanism B is installed, the mechanism B is inserted into the receiving cavity 12, the mechanism B is pressed downward, the fork 3 and the base 1 on the mechanism B are positioned through the convex rib 36, then the mechanism B is continued to be pressed downward, the plurality of elastic hooks 35 on the fork 3 are in snap-fit connection with the barb ribs 13 on the base 1, and then in combination with the anti-rotation fit between the anti-rotation teeth B 37 and the anti-rotation teeth A 14, the mechanism B can be installed on the base 1.

In conclusion, according to the present invention, through structural improvement, the fork and the base are designed in a "detachable engagement and circumferential stop" connection mode, which is convenient for the consumers to easily separate and combine the mechanism and the base through an operation mode of "pulling out" and "pressing down" on the basis of ensuring a stable structure of a lipstick tube, that is: when new lipstick needs to be replaced, the consumers can easily pull out the old mechanism, and install the new mechanism successfully by pressing down. On the one hand, the lipstick tube of the present invention is simple and novel in structure, and easy to operate, which greatly satisfies demands of the consumers. On the other hand, in the lipstick tube, the base and the cover can be recycled, which not only saves shopping costs for the consumers, but also makes the lipstick tube more environmentally friendly.

The above are merely descriptions of preferred implementations of the present invention, but are not intended to limit the present invention. It should be noted that many modifications and variations can be made by those of ordinary skill in the art without departing from the technical principle of the present invention, and these modifications and variations should also be deemed as falling within the protection scope of the present invention.

What is claimed is:

1. A lipstick tube with a replaceable mechanism, comprising a base and the replaceable mechanism, wherein the replaceable mechanism comprises a barrel, a fork, a spiral component and an aluminum shell, wherein the barrel, the fork, the spiral component and the aluminum shell are coaxially sleeved sequentially from inside out, a barrel engaging member integrally protrudes from an outer side wall of the barrel, a hollow guide groove extending in an axial direction of the fork is formed in the fork, a spiral guide groove extending in an axial direction of the spiral component and spiraling upward is formed in an inner side wall of the spiral component, the barrel engaging member is configured for passing through the hollow guide groove and then being embedded into and sliding in the spiral guide groove, the spiral component is configured for axially stopping and circumferentially rotating relative to the fork, and the aluminum shell is configured for being fixed in position relative to the spiral component; and a bottom of the fork is configured for being detachably engaged on the base, and the fork is configured for circumferentially stopping relative to the base, wherein the base comprises:

a base casing in a hollow cylindrical shape and with an open upper shaft end, a base inner column integrally formed on an inner surface of a lower shaft end of the base casing and extending in an axial direction of the base casing, and a receiving cavity formed between the base casing and the base inner column;

wherein a circle of barb ribs are formed in an inner side wall of the base casing, and a circle of first anti-rotation teeth are formed at an upper part of an outer side wall of the base inner column;

the fork comprises a fork body, the fork body is of a first hollow cylindrical structure with an open upper shaft end and an open lower shaft end, a plurality of separation grooves extending in an axial direction of the fork body and opening at the open lower shaft end of the fork body are formed at a bottom of the fork body, and the plurality of separation grooves are arranged in a first ring row to separate the bottom of the fork body into a plurality of elastic members; the plurality of elastic members comprise a plurality of first elastic members and a plurality of second elastic members, wherein the plurality of first elastic members and the plurality of second elastic members are alternately distributed in sequence, a plurality of elastic hooks are respectively integrally formed on outer side walls of the plurality of first elastic members, and a convex rib is integrally formed on an outer side wall of each of the plurality of second elastic members; and an inner side wall of the fork body extends radially inward at a position adjacent to the plurality of separation grooves to form a convex ring, and a circle of second anti-rotation teeth are formed on an inner wall of the convex ring; and when the bottom of the fork body is inserted into the receiving cavity, the plurality of elastic hooks are configured for being respectively engaged with the barb ribs, and the second anti-rotation teeth are configured for being connected to the first anti-rotation teeth in an anti-rotation fit.

2. The lipstick tube with the replaceable mechanism according to claim 1, wherein the base inner column is of a second hollow cylindrical structure with an open upper shaft end, and the base inner column is coaxially arranged with the base casing;

a plurality of first supporting ribs distributed in a second ring row integrally protrude from an inner side wall of a lower part of the base casing, a plurality of second supporting ribs distributed in a third ring row integrally protrude from an outer side wall of a lower part of the base inner column, and the plurality of first supporting ribs and the plurality of second supporting ribs are located at a same radial plane; and a ring-shaped vertical weight is provided, the ring-shaped vertical weight is disposed in the receiving cavity, and the plurality of first supporting ribs and the plurality of second supporting ribs correspondingly abut against an outer side wall and an inner side wall of the ring-shaped vertical weight, respectively.

3. The lipstick tube with the replaceable mechanism according to claim 1, wherein a first limit ring integrally protrudes from an outer side wall of the open upper shaft end of the fork body, a second limit ring integrally protrudes from an outer side wall of a lower part of the fork body, a part between the first limit ring and the second limit ring on the fork body is defined as an installation section, and the hollow guide groove is formed in the installation section;

the spiral component comprises a spiral body in a first hollow straight circular tubular shape, the spiral body is movably sleeved on the installation section, and the first limit ring and the second limit ring stop and limit an upper shaft end and a lower shaft end of the spiral body respectively; and the spiral guide groove is formed in an inner side wall of the spiral body.

4. The lipstick tube with the replaceable mechanism according to claim 3, wherein the aluminum shell comprises an aluminum shell body in a second hollow straight circular tubular shape, wherein the aluminum shell body is sleeved outside the spiral body, and the aluminum shell body is fixedly connected to the spiral body through dispensing fixation; and a circular groove is formed on an outer side wall of the fork body and located between the second limit ring and the plurality of elastic members, a plurality of elastic pieces are arranged in a fourth ring row in the circular groove, and the plurality of elastic pieces each elastically abut against an inner side wall of the aluminum shell body.

5. The lipstick tube with the replaceable mechanism according to claim 1, further comprising a cover, wherein the cover comprises a cover body, the cover body is of a third hollow cylindrical structure with an open lower shaft end, and a circular engaging groove is recessed on an inner side wall of the cover body at a position adjacent to a lower opening of the cover body; and an outer diameter of an upper part of the base casing is less than an outer diameter of a middle and lower part of the base casing, a plurality of base engaging members distributed in a fifth ring row integrally protrude from an outer side wall of the upper part of the base casing, and the plurality of base engaging members each are configured for being engaged with the circular engaging groove.

* * * * *